US006864846B2

(12) United States Patent
King

(10) Patent No.: US 6,864,846 B2
(45) Date of Patent: Mar. 8, 2005

(54) SATELLITE LOCATOR SYSTEM

(76) Inventor: Lael D. King, 5100 W. 36th St., St. Louis Park, MN (US) 55416

( * ) Notice: Subject to any disclaimer, the term of this patent is extended or adjusted under 35 U.S.C. 154(b) by 0 days.

(21) Appl. No.: 10/742,612

(22) Filed: Dec. 19, 2003

(65) Prior Publication Data

US 2004/0160375 A1 Aug. 19, 2004

Related U.S. Application Data

(63) Continuation of application No. 10/395,871, filed on Mar. 24, 2003, now Pat. No. 6,710,749, which is a continuation of application No. 09/525,790, filed on Mar. 15, 2000, now Pat. No. 6,538,612.

(51) Int. Cl.[7] ..... H01Q 3/00

(52) U.S. Cl. ..... 343/757; 343/765; 343/713; 343/840

(58) Field of Search ..... 343/757, 763, 343/765, 766, 711, 713, 840

(56) References Cited

U.S. PATENT DOCUMENTS 4,654,670 A 3/1987 Fleming
4,804,972 A 2/1989 Schudel
5,019,833 A 5/1991 Nonaka
5,274,382 A 12/1993 Wills et al.
5,309,162 A 5/1994 Uematsu et al.
5,398,035 A 3/1995 Densmore et al.
5,448,254 A 9/1995 Schneeman et al.
5,471,219 A 11/1995 Rodeffer et al.
5,528,250 A 6/1996 Sherwood et al.
5,945,945 A 8/1999 Wagner et al.
5,983,071 A 11/1999 Gagnon et al.
6,029,044 A 2/2000 Arsenault et al.

*Primary Examiner*—Hoang V. Nguyen
(74) *Attorney, Agent, or Firm*—Patterson, Thuente, Skaar & Christensen, PA.

(57) ABSTRACT

A satellite locator system used with a motor home has a parabolic reflector antenna dish, feedhorn and signal converter mounted on a turntable supporting electronic controls and elevation and azimuth motors operable to rotate the turntable and change the elevation of the dish to locate and target a satellite. A plastic dome mounted on a base plate attached to the roof of the motor home encloses the dish, feedhorn, signal converter, turntable, electronic controls, and elevation and azimuth motors. The dome has an inner semi-hemispherical surface located close to the signal converter to improve the signal strength. A remote console wired to the electronic controls is operable to initiate the satellite search and monitor the status of the satellite search.

6 Claims, 6 Drawing Sheets

31
42
45
46
43
44
79
81
4
49
63
66
64
67
68
69
72
71
58
103
62
60
61
57
102
70
74
75
76
73
56
47
48
107
106
35
23
36
41
32
54
52
55
33
51
78
77
57

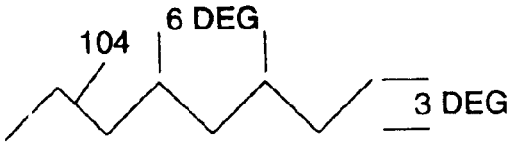
FIG. 7
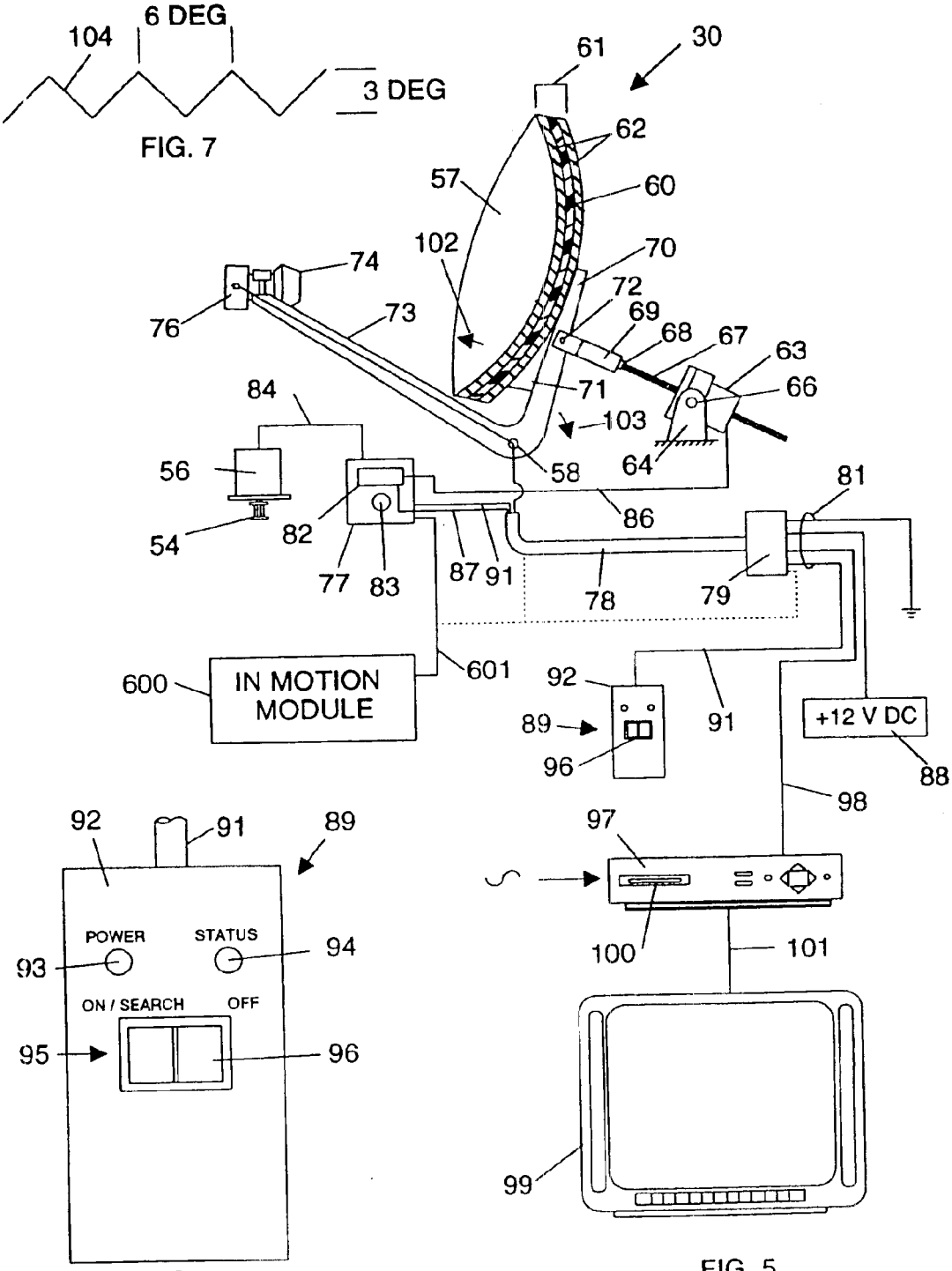
FIG. 5
FIG. 6

SATELLITE LOCATOR SYSTEM

RELATED APPLICATIONS

This application is a continuation of U.S. application Ser. No. 10/395,871, filed Mar. 24, 2003 now U.S. Pat. No. 6,710,749, entitled SATELLITE LOCATOR SYSTEM, which in turn is a continuation of U.S. application Ser. No. 09/525,790, filed Mar. 15, 2000 Now U.S. Pat. No. 6,538,612, entitled, SATELLITE LOCATOR SYSTEM, the entire disclosures of which are considered as being part of the disclosure of the accompanying application and are hereby incorporated by reference.

FIELD OF THE INVENTION

The present invention relates to a satellite locator system used with a mobile unit, such as a recreational vehicle, bus, automobile, over the road commercial freight truck, train or ship for searching the sky for a selected satellite and locking onto the satellite.

BACKGROUND OF THE INVENTION

The conventional satellite communications systems have microwave receiving antennas or parabolic reflector dishes connected to arms supporting feedhorns and signal converters. Cables couple the convertors to receivers which provide converted output signals for conventional televisions. The antennas are mounted on supports fixed to the ground or a building. Antenna direction adjusters associated with the supports and antennas are used to locate the antennas in the direction of a selected satellite. The adjusters change the elevation and azimuth angles of the antennas and maintain adjusted positions of the antennas. The antenna adjustments depend on the location of the antennas on the surface of the Earth since the satellites are in orbit in the Clarke Belt and remain in fixed positions relative to the surface of the Earth. When the satellite communication systems are moved to a new location the elevation and azimuth angles of the antennas must be adjusted to align the antennas with the selected satellite. Mobile units, such as motor homes, travel and recreational vehicles have been equipped with satellite communication systems for conventional televisions. These communication systems have satellite signal receiving antennas mounted on the roofs of the vehicles. The antennas include parabolic dishes which are exposed to the outside environment, wind, insects, mud, dirt, dust, snow, ice and UV radiation. In some installations, the exposed dishes are pivoted to a generally horizontal non-functional position when the vehicle is moving to reduce the wind forces on the dishes. The dishes must be returned to their operating positions and the elevation and azimuth locations of the dishes must be adjusted to locate a desired satellite. The dishes are operatively associated with gear trains manually operated with knobs and cranks to change the elevations and azimuth positions of the dishes to search for a selected satellite. Tripod and hand crank mounts for portable satellite dishes are disclosed by Y. Nonaka in U.S. Pat. No. 5,019,833. A linear actuator operable to pivot a satellite dish is disclosed by C. R. Schudel in U.S. Pat. No. 4,804,972. In some satellite communication systems positioners having electric motors are used to operate the gear trains. The dishes are attached to polarmounts which enables the dishes to track the whole of the Clarke Belt. M. Vematsu, T. Ojima and M. Ochiai in U.S. Pat. No. 5,309,162 disclose a satellite antenna for a mobile body having electric motors to elevate and rotate the antenna. The automatic satellite locator systems have antennas that are exposed to the outside environment.

SUMMARY OF THE INVENTION

The satellite locator system is used with mobile units, such as recreational vehicles, ships, trains, or buses, to locate a selected satellite when the mobile units are stationary in different locations. The system scans the sky to locate one or more satellites orbiting in the Clarke Belt. When the desired satellite is located, the scanning ceases and the antenna or dish is locked onto the satellite. A dome of dielectric material mounted on the mobile unit, such as the roof of a recreational vehicle, covers the dish, feedhorn, converter, and dish mount and elevation and azimuth controls to provide protection from wind, rain, snow, ice, dust, dirt, insects and other environmental conditions. The dome is a lightweight ultra violet light protected plastic semi-hemispherical cover having an inside concave surface located in close proximity to the converter to improve satellite signal strength. The dome covers a vacuum formed or injection molded plastic concave paraboloid or antenna reflector dish that is vacuum metalized or coated with aluminum for optimal reflectivity. The dish has a plastic parabolic body with a completely metalized surface, which has virtually, zero ohm resistance across the antenna surface. Dish elevation and azimuth rotation is achieved with electric stepper motors. The elevation motor periodically reverses its drive to vary the elevation of the dish simultaneously with the rotation of the dish to establish a band or sawtooth 360° search pattern. This search pattern allows for scanning a greater area of the sky in a shorter period of time than conventional satellite systems having linear elevational search patterns or linear azimuth search patterns that are parallel or perpendicular to the Earth's surface. The motors are controlled with the use of electronic controls including a microprocessor and an electronic level sensor to compensate for vehicle tilt. The electronic controls can be programmed and reprogrammed to upgrade the satellite locating system. Additional components can be added to the controls to provide a satellite locating system to continuously search and lock onto a satellite during movement of the mobile unit. The microprocessor is programmed to monitor and maximize signal strength and converter to receiver polarization to identify a satellite. The control operates to monitor voltage changes of the receiver to determine if the signals from the located satellite matches the receiver and service provider's operating criteria. When the voltage change stops, a signal is sensed by the console which indicates to the user that the satellite locator apparatus has locked onto a satellite. The satellite signals are continuously averaged during the search for satellites. The average signal level is used as a reference which changes dynamically during the satellite search. When a search for a second satellite is started, the last average signal is used as a starting signal average. In the event that the located satellite is not compatible with the receiver or service provider, the control stores data representing the location of the satellite and bypasses the satellite in a search for another satellite. The 12 volt DC power of the vehicle is used to power the system. The operator or person within the vehicle uses a remote console electrically connected to the electronic control to commence the scanning operation for a desired satellite, monitor the status of the, system, and terminate the scanning when the dish is pointed at the selected satellite. One form of the console has ON/OFF switches, a 12 digit key pad and a 2 digit numeric display that communicates serially with the antenna unit and permits the operator to monitor status and control the elevation and azimuth of the dish. In another form, the console has a single three-position switch and two lights that indicate the system's status and when a satellite has been located and locked onto the system.

BRIEF DESCRIPTION OF THE DRAWINGS

FIG. 5 is a diagrammatic view of the satellite locator system of the invention;

FIG. 6 is a front elevational view of the switch control console used to initiate satellite searches;

FIG. 7 is a visual of the satellite signal search pattern of antenna dish;

DETAILED DESCRIPTION OF THE PREFERRED EMBODIMENTS

Figure 1:
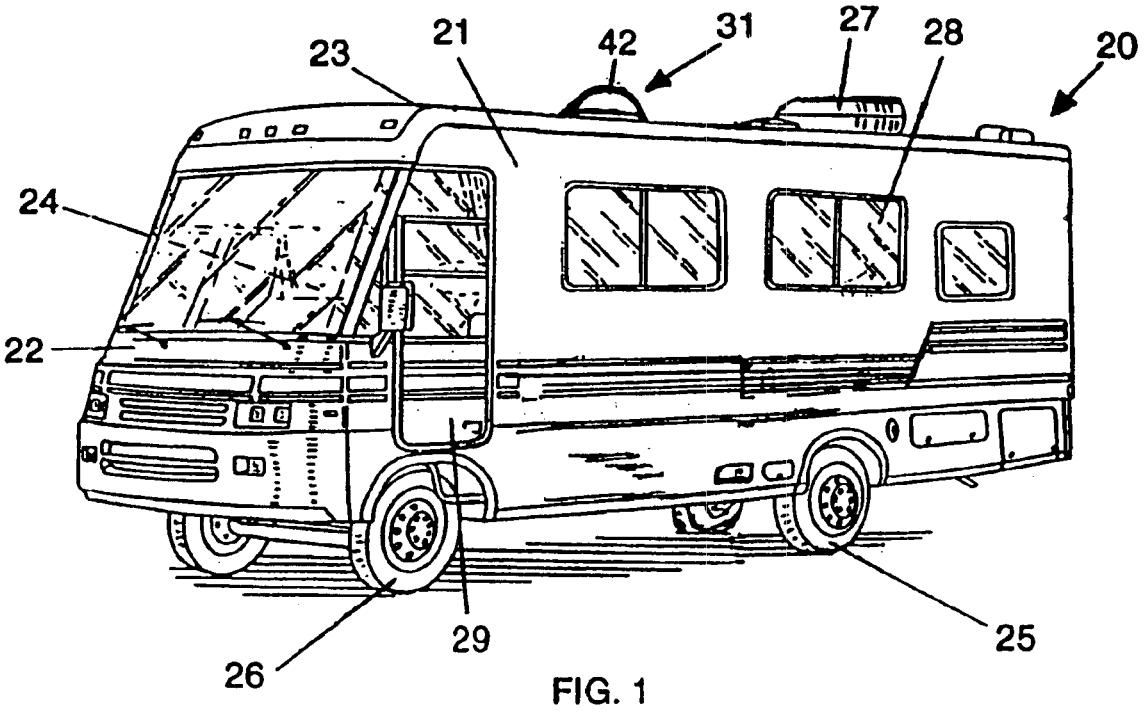
FIG. 1 is a perspective view of a recreational vehicle equipped with the satellite locator system of the invention.

A recreational vehicle 20, shown in FIG. 1, is a motor home equipped with a satellite locator system operable to locate satellite signals from different geographic locations. Vehicle 20 can be a van, recreational vehicle, motor home, travel trailer, pick-up camper, tent trailer, house boat, motor boat, sail boat, truck or ship that moves from place to place having a satellite TV system. Buses and trains can be equipped with the satellite locator system. The vehicle is a conventional motor home having upright sidewalls 21 with windows 28 and a front cowl and windshield 22 joined to a generally horizontal roof 23. The interior of the motor home includes a driver's compartment and a living area. Sidewall 21 has a door 29 providing an entrance to the driver's compartment. A conventional television set is usually located in the living area of the motor home. The motor home has rear drive wheels 25 and front steering wheels 26 supported on a road or parking area. An air conditioner 27 is located on roof 23 rearwardly of a satellite locator system.

The vehicle is described as a mobile unit that is moved from place to place and parked in a stationary location, such as a recreational vehicle park. The satellite locator system of the invention operates when the mobile unit is stationary to locate and lock onto a satellite that is compatible with the receiver and provider service.

A number of satellites or birds located in the Clarke Belt orbit around the earth in 24 hours. The satellites are spaced from each other and remain in fixed positions relative to the Earth's surface. Each satellite has transponders operable for receiving uplinked channels and rebroadcasting or downlinking a raw TV signal or beam to earth. The satellite locator system 30 has a satellite signal locator device 31 mounted on roof 23 of vehicle 20, which locates and delivers satellite signals to a receiver 97. Device 31 has dish antenna 57 comprised of a parabolic reflector dish and a feedhorn 74 mounted on an arm 73, which collects the signals at the focus of dish antenna 57 and channels the collected signals to a low noise block converter 76. Converter 76 amplifies the signals and converts them from microwaves to low frequency signals that are sent along a cable 98 to receiver 97. Receiver 97 includes a decoder operable to unscramble audio and video signals that is protected by encryption. A smart card 100 is used to unscramble encrypted broadcasts when placed in a decoder. The receiver can have a built in decoder. The receiver 97 converts the signals so they can appear on the CRT or screen of television 99. The receiver 97 and television 99 are conventional electronic units used with the satellite locator system of the present invention.

The baseboard or raw satellite signal has a bandwidth or range of frequencies that receiver 99 is capable of receiving. This satellite downlink signal is located in a transmission pattern or beam directed to an area or footprint of the earth that is able to receive a particular satellite signal. Dish 57 must be targeted at a particular satellite in order to receive signal intensity sufficient to operate receiver 97 and television 99. When a dish antenna is in a fixed location, such as a building, dish 57 can be targeted at a particular satellite. Further adjustment of the elevation and azimuth of dish 57 is not required to maintain the dish on target with the satellite. When dish 57 is mounted on a movable vehicle or moved to a new location on the surface of the Earth, the elevation and azimuth of the dish must be adjusted in order to target the satellite or target a new satellite. The dish 57 is moved to find a selected satellite from any location of vehicle 20 within the contiguous United States, southern Canada and northern Mexico. In order for a satellite to be found, the vehicle 20 must be parked in a manner so the line of sight satellite signal locator device 31 has a mostly unobstructed view of the southern sky.

Figure 2:
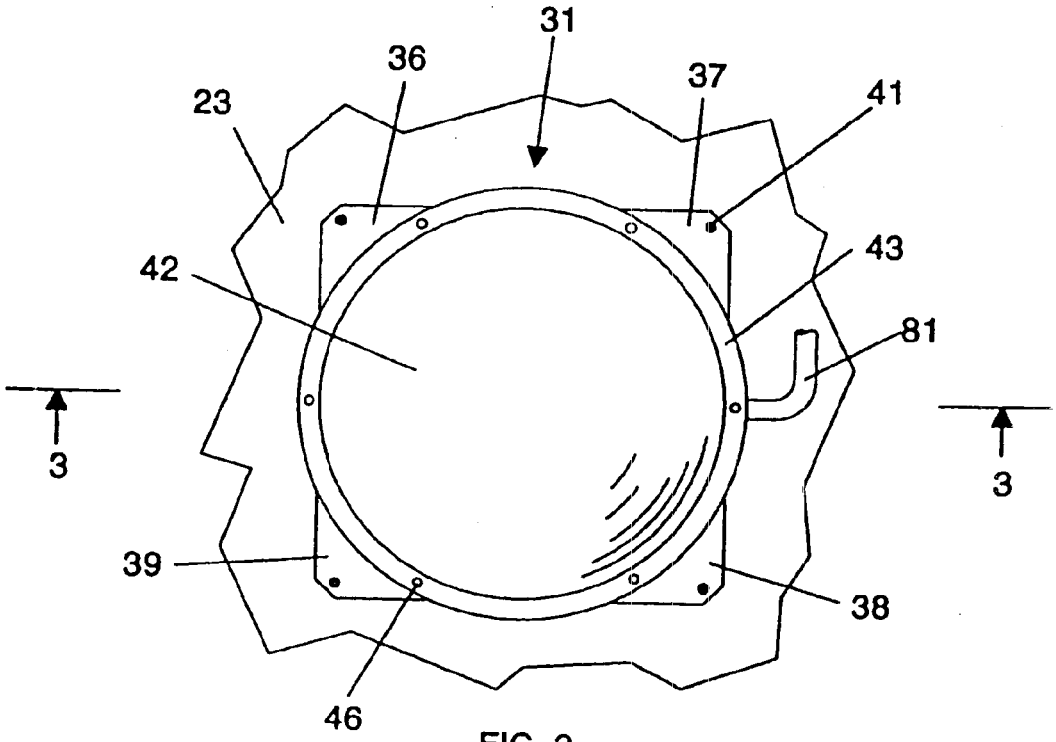
FIG. 2 is a top plan view of the dome covered antenna unit of the satellite system on the roof of the recreational vehicle.

As shown in FIGS. 1 and 2, satellite signal pick-up device 31 is located near the longitudinal center line of roof 23 in an area of roof 23 that is free of line of sight obstructions, such as air conditioner 27, cargo boxes and antennas. The signal reflective roof mounted objects and components must be located below an angle drawn from the center of device 31 up 20°—from the top of the roof. A wire junction box 79 houses releasable connectors 81 for device 31. Box 79 is positioned to the rear of vehicle 20.

Figures 3, 3A:
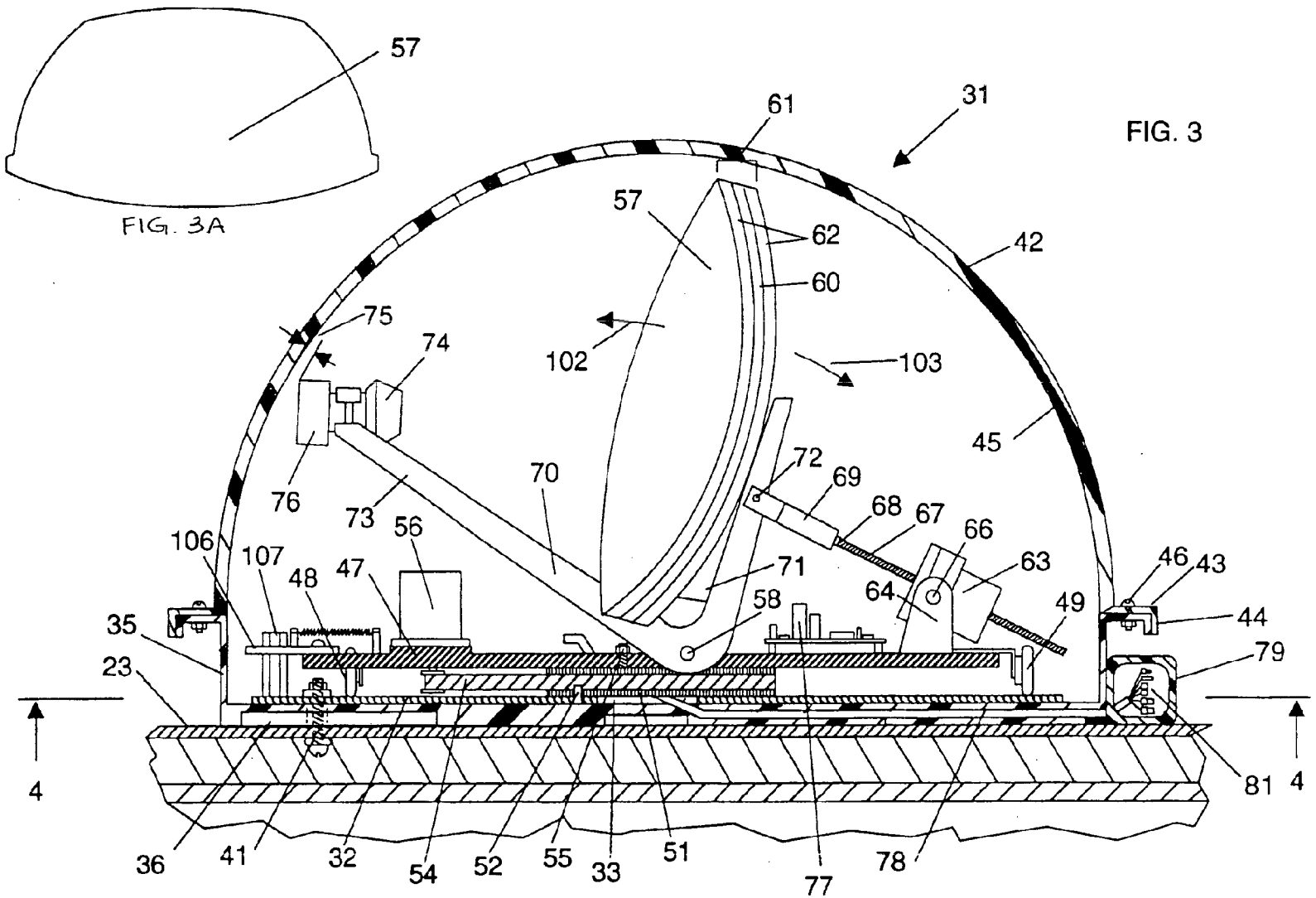
FIG. 3 is an enlarged sectional view taken along the line 3—3 of FIG. 2.
FIG. 3A is a front elevational view of the parabolic dish shown in FIG. 3.

Device 31, shown in FIG. 3, has a circular flat base plate 32 having a central hole 33. An ultra violet light protected cylindrical case 35 connected to the bottom of plate 32 is secured to four mounting feet 36, 37, 38, and 39. Case 35 is a cylindrical pan-shaped plastic member having a bottom wall that engages mounting feet 36–39 to the roof 23 of the vehicle and an upright cylindrical wall with an outwardly directed flange that serves as a support and engagement for a dome 42. Bolts, screws, or threaded studs 41, or expansion nuts attached to roof 23 anchor feet 36–39 to roof 23. Dome 42 is a semi-hemispherical plastic cupola or cover located over case 35. The plastic can be rigid polyethylene, ABS, similar rigid plastics, or dielectric materials, with a bonded ultra violet light resistant coating. The lower annular end of dome 42 has an outwardly directed flange 43 joined to a downwardly directed cylindrical lip 44. Flange 43 rests on an annular outer flange of case 35 and is secured to case 35 with a plurality of bolts 46. Other types of fasteners can be used to connect dome 42 to case 35. When flange 43 is secured to case 35, lip 44 extends around the outer edge of case 35, as shown in FIG. 3, to inhibit movement of dome 42 relative to case 35 and prevent snow, water, mud, dust, insects, and dirt from flowing under flange 43 into the space enclosed by dome 42. Dome 42 protects dish 57, horn or primary signal receiver 74, the low noise block converter 76, electronic control 71 and related structures located under dome 42 from external weather conditions, such as wind, dust, hail, water, snow, insects, dirt, ultra violet light radiation, and the external environment. Dome 42 is a simple and effective plastic structure that protects dish 57 and all components located under the dome.

Figure 4:
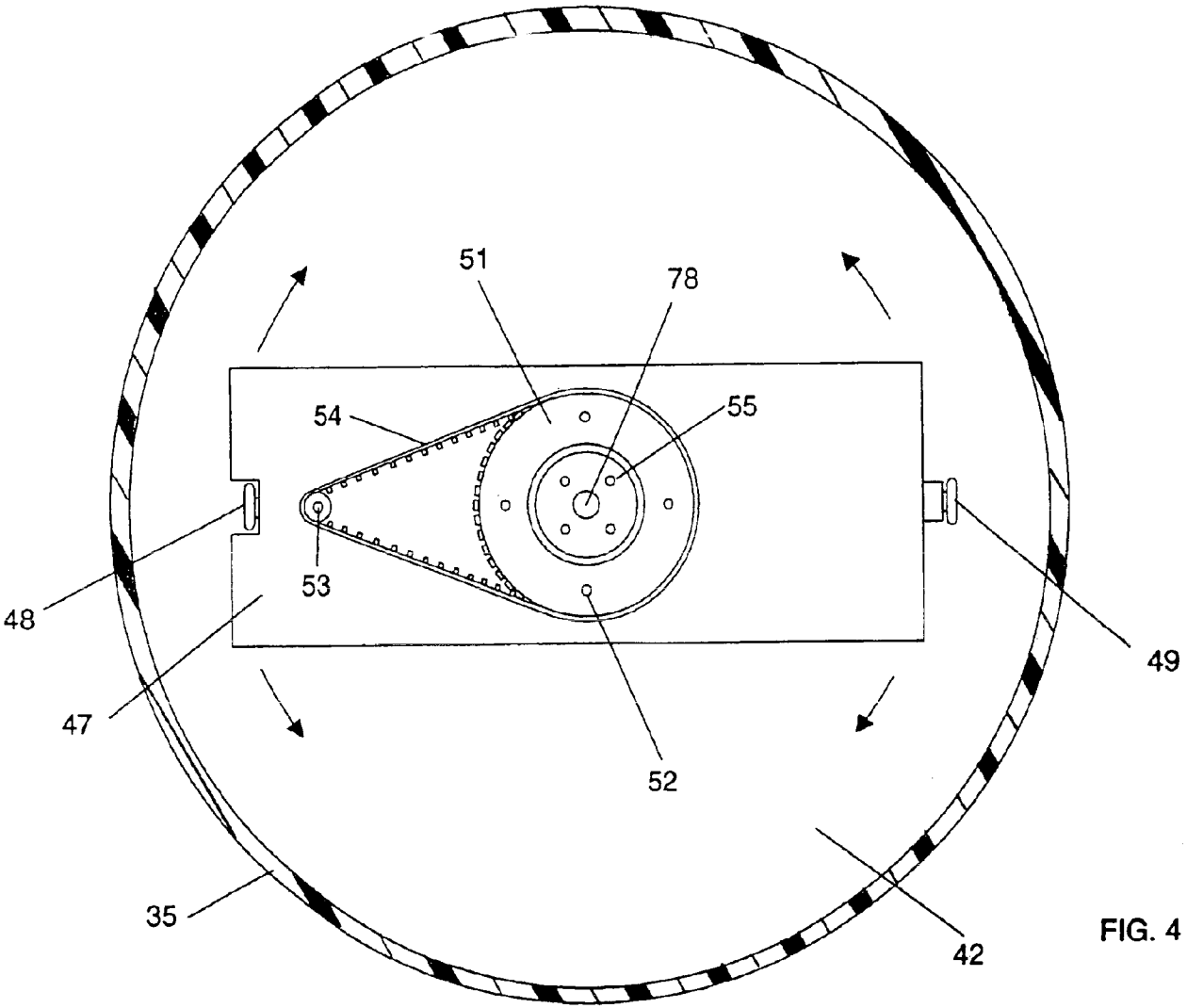
FIG. 4 is a sectional view taken along line 4—4 of FIG. 3.

A platform or turntable 47 is movably supported on base plate 32 with a pair of wheel assemblies 48 and 49. As shown in FIGS. 3 and 4, wheel assemblies 48 and 49 mounted on opposite ends of turntable 47 ride on the top surface of base plate 32. Other structures can be used to rotatably mount turntable 47 on base plate 32. Turntable 47 is rotated about a vertical axis or axis perpendicular to the ground to change the azimuth or pointing direction of dish 57. As shown in FIGS. 3 and 4, a pulley grooved bearing 51 is connected to the center of base plate 32 with fasteners 52 such as bolt or screws. A drive pulley 53 connected to the output shaft of an electric DC stepper motor 56 accommodates an endless belt 54 trained about pulley 51. Fasteners 55, such as bolts or screws, secure the center of bearing 51 to turntable 47 with nuts or similar retainers to retain the axial location of turntable 47 on bearing 51 and base plate 32. Turntable 47 rotates about the upright axis of bearing 51. Motor 56 is mounted on turntable 47 radially offset from its axis of rotation so that on operation of motor 56, pulley 53 is rotated and moves belt 54 around bearing 51 thereby rotating turntable 47 and dish 57. A switch having a spring-biased arm 106 pivotally mounted on turntable 47 is wired to control 77 for motor 56. Arm 106 engages an upright member 107, which triggers the switch with each revolution of turntable 47. The control 77 operates to reverse the drive of motor 56 after two revolutions of turntable 47 to avoid excess twisting of cable 78.

Dish 57 is a parabolic signal reflector or dish pivoted with a horizontal pivot pin 58 mounted on turntable 47. Dish 57 is a concave paraboloid having a semicircular shape with a major horizontal axis. The outer sides and top edges of dish 57 are located in close spaced relationship relative to the inside semi-hemispherical surface 45 of dome 42. Returning to FIG. 3, dish 57 has a parabolic curved plastic body 60 with a rearwardly directed flange 61 located at the outer peripheral edge of body 60. Body 60 and flange 61 is a one-piece plastic member. A metal skin or layer 62, such as aluminum, attached to the front and back curved surfaces of body 60 and flange 61, the metal skin on the front surface of body 60 focuses and reflects satellite signals to feedhorn 74. The metal skin on the back of body 60 and flange 61 can be provided with etched patterns that enable the dish to be used as a satellite antenna and an UHV/VHF antenna. A gray paint is located on the front metal skin to reduce solar focus rays. As shown in FIG. 3A, the front concave surface of dish 57 has a general oval shape with convex curved side edges and top edge which are generally concentric with the curved shape of the inside surface 45 of dome 42. The convex edges of dish 57 are located close to the inside surface 45 of dome 42. The dish 57 has a horizontal dimension that is about twice as long as its vertical width.

The elevation of dish 57 is adjusted with a second electric DC stepper motor 63 pivotally mounted on a U-shaped bracket 64 with transverse pivot members 66. Motor 63 rotates a lead screw 67 threaded into a nut 68. A U-shaped yoke or bracket 69 has a center portion secured to nut 68 and side portions secured to member 70 with screws 72. Screws 72 pivotally connect bracket 69 to opposite sides of member 70 for pivotal movement about a horizontal axis parallel to the axis of pin 58. Member 70 is attached to a plastic member 71 located at the center section of the convex back of dish 57 with an adhesive or fasteners. Lead screw 67, nut 68 and tubular bracket 69 comprise a linear actuator operated with motor 63 to increase and decrease the operating length of the actuator to pivot dish 57 about the horizontal axis of pivot pin 58 to change the elevation angle of dish 57. Motor 63 sequentially operates in forward and reverse drive directions to sequentially change the elevation of dish 57, as illustrated by the search pattern 104 shown in FIG. 7. Dish 57 pivots on pin 58 in opposite directions, shown by arrows 102 and 103 in FIG. 5, to provide a vertical search pattern of three degrees as the dish rotates about a vertical axis. Motor 56 rotates turntable 47 six degrees which is coordinated with the vertical search pattern cycle of dish 57. Other vertical search patterns can be used to locate a satellite.

The dish 57 is mounted on a V-shaped member 70 having an upwardly and outwardly inclined arm 73. Member 70 is pivotally supported on pivot pin 58. Arm 73 also moves in a circular path when turntable 47 is rotated. A primary signal receiver or feedhorn 74 mounted on the outer end of arm 73 is located at the focus of dish 57. A signal converter 76, such as a low noise block converter with integrated feed, is mounted on arm 73 outwardly of feedhorn 74. As seen in FIG. 3, converter 76 is located in contiguous relation with respect to the inside wall 45 of dome 42. Converter 76 is adjacent the inside wall of dome 42 as it is pivoted up and down and moves around in inside of dome 42 as the system searches for a signal from a satellite. The distance 75 between converter 76 and the inside wall 45 of dome 42 is between 1 to 2 cm. The close spaced relationship between converter 76 and dome 42 improves the efficiency and satellite signal strength received by dish 57. Feedhorn 74 is enclosed in a light or thin cover as it is protected by dome 42. The lightweight cover of feedhorn 74 results in a higher satellite signal strength. The conventional cover for the feedhorn, made for outdoor use, is a plastic member having ultra violet light protection properties. The cover for feedhorn 74 is a thin plastic member that does not have ultra violet light protection properties. Converter 76 amplifies received signals and converts them from microwaves to lower frequency signals, which are sent along a coaxial cable 98 to satellite receiver 97. Receiver 97 is a commercial unit, which recognizes the signals from converter 76 and generates signals useable by television set 99 to display a visual picture and transmit audio information. A cable 101 connects receiver 97 to television set 99.

As shown in FIG. 5, an electronic control module 77 having a microprocessor 82, such as a Motorola MC 6811 microprocessor, and electronic level sensor 83 is connected with electrical conductor lines 84 and 86 to motors 56 and 63 and a line 87 to electric power source 88 with a cable 78. Control module 77 can have additional microprocessors. The microprocessor monitors a voltage change (−12V to −18V) of a timing monitor, located within receiver 97, to determine if the satellite that has been located matches the user's receiver and service provider's operating criteria. The voltage change stops when a satellite has been locked on and receiver 97 recognizes the satellite as part of its system. This eliminates the need for an additional low speed data port interface between the receiver and control 77 and associated wiring, hardware, and software. A single coaxial cable 98 fully connects control module 77 with receiver 97 whereby all the monitoring and communication is accomplished via the coaxial cable. The satellite locator system 30 is not dependant on the protocol or effected by changes made to the protocol by the receiver manufacturer or the satellite service provider. The satellite locator system 30 is compatible with all commercial receivers without additional hardware or hardware changes. The user can change to a different satellite receiver or service provider without altering the hardware or software.

Level sensor 83 is an electronic leveler mounted on electronic control module 77 that rotates with and is mounted on turntable 47. The leveler adjusts the elevation of dish 57 and automatically compensates for any unlevelness during all 360° of a potential search pattern. Level sensor 83 compensates for tilt and inclined positions of the parked mobile unit. Electric power source 88 is a 12-volt DC power supply or the battery of vehicle 20 that provides the electric power to control module 77, and electric motors 56 and 63. As shown in FIG. 3, a bundle of cables 78 are terminated with releasable connectors 81 located in junction box 79. Releasable connectors 81 are joined with electric lines, such as coaxial cables and a power line, to ground power source 88, receiver 97, and a remote controller indicated generally at 89. An elongated flexible electric conductor cable 91, such as a six-conductor telephone cable, operatively connects controller 89 with electronic control module 77. The satellite locator system 30 is compatible with a DSS and ECHOSTAR receivers without special hardware without connection to receiver 97 low speed data port. The electronics of controller 77 are programmable and reprogrammable and require no additional hardware or hardware changes. The controller electronics dynamically averages the signal strength it receives as it searches for satellites. Continuous averaging is used as a reference level while searching. The previous search average is used as a starting value for the next new search. Dynamic signal strength averaging filters out the continuously changing background noise. Potential false signals from power lines, antennas and power supplies of created or reflected noises are not accepted by the system. This prevents the system from locking onto an incorrect location.

Controller 89, receiver 97 and television 99 are all located within vehicle 20 in positions where they can be used by a person in vehicle 20. As shown in FIG. 6, controller 89 has a rectangular case 92 enclosing electric circuits that include signal lights or light emitting diodes 93 and 94 capable of multiple colors and blank frequencies. Power light 93 illuminates when controller 89 is receiving electric power. The status light 94 provides the operator with color and flash series representing the status of the system. A three position momentary switch 95 having a laterally moveable actuator 96 is included in the controller electrical circuit. Actuator 96 and the switch return to neutral after activation. Switch 95 has two positions, ON and SEARCH, toward power light 93 and one position, OFF toward status light 94.

Controller 89 is used to commence automatic scanning of the sky to locate a desired satellite. When the satellite is located, the scanning will cease, as dish 57 is pointed at the satellite. The receiver 97 and television 99 are first turned ON. The satellite search is initiated by pressing and holding switch 95 in the power ON position for 2 seconds. When actuator 96 is released switch 95 returns to its neutral position. The status light 94 blinks red indicating that a satellite search is in progress. Azimuth motor 56 rotates turntable 47, which moves dish 57, arm 73, feedhorn 74, and converter 76 in a circular path within dome 42. Elevation motor 63 sequentially turns lead screw 67 in opposite directions to pivot dish 57 and arm 73 about the horizontal axis of pin 58. Dish 57 and arm 73 oscillate between selected limits, such as three degrees as shown in the search pattern in FIG. 7. Each oscillating cycle is completed every six degrees of rotation of dish 57. Varying elevation of dish 57 simultaneously with rotation of dish 57 enables the satellite locator system to quickly search a wide area or band of the sky for a signal. The satellite locator system begins a new satellite search from the last elevation at which a satellite was previously located. This allows the operator to rapidly locate a satellite after the vehicle has traveled north or south from a previous location.

The status light 94 displays a blinking green light when a satellite is located. Light 94 changes to steady green when the satellite locator system is locked onto a satellite. An image is present on the screen of the television set 99 when dish 57 is locked onto the satellite. Switch 95 can be turned off when the selected satellite is located. In the event that another satellite is 14 desired, the search is continued. Switch 95 is turned ON again to resume the search. If the satellite locator system does not find a satellite or does not find a second satellite, it is likely that there is an obstruction in the line of sight to the satellite. If the entire sky is scanned and no satellite is found, status light 94 will illuminate with a blinking orange light. The outer surface of dome 42 must be cleaned of dirt, bugs, bird droppings, and other debris for optimum satellite signal strength. Once the system locates and locks onto a satellite, it stores the location of the satellite in memory. If the specific satellite does not have programming that is desired by the viewer, switch 96 can be activated to continue a search for a next satellite supported by the service provider. The system will not return to any undesired locations in memory unless the system is reinitialized.

As shown in FIG. 5, satellite locator system 30 can be upgraded to a system wherein the desired satellite remains locked on during movement of the mobile unit. A telephone line or cable 201 connects an in-motion module 200 to control 77 to provide communication between control 77 and module 200. Module 200 can be located under dome 42 or within the mobile unit to minimize electronic error due to instruments and equipment adjacent dome 42, and within the mobile unit and to facilitate simple upgradability. The motion module 200 generates a direction signal indicating magnetic north for the location of the mobile unit and senses motion via a gyroscope instrument. The directional signal is used by control 77 to change the azimuth of dish 57 to face the dish toward the southern sky and directly focused on a selected satellite. Motion module 200 has electronics, such as an electronic compass and/or a gyroscope instrument. The gyroscope instrument provides the directional signal required to ensure that dish 57 points directly at and stays locked on a selected satellite regardless of the motions of the mobile unit.

Figures 8, 9:
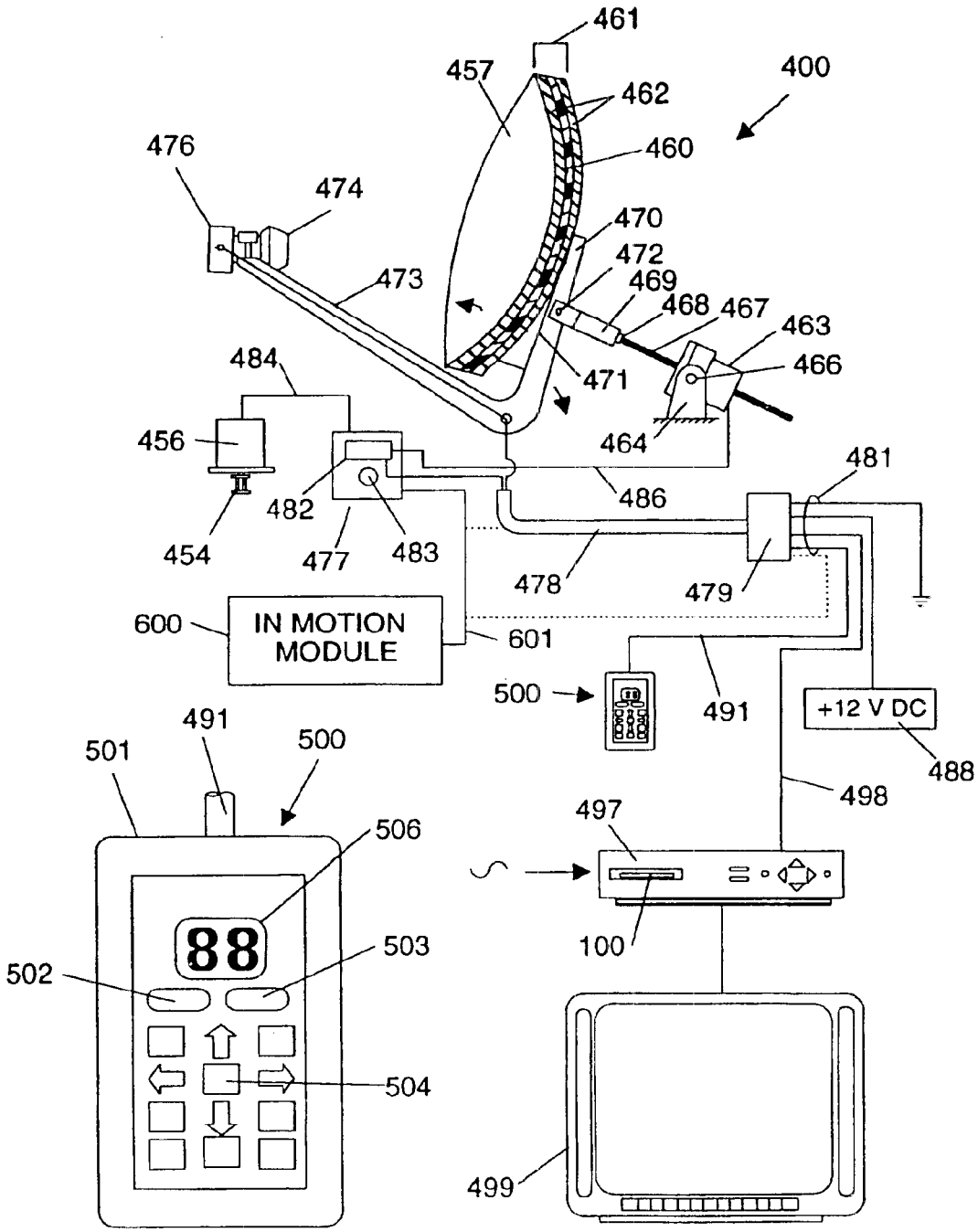
FIG. 8 is a diagrammatic view of a modification of the satellite locator system of FIG. 5.
FIG. 9 is a front elevational view of the keypad console used to conduct satellite searches.

A modification of the satellite locator system 400 of the present invention, shown in FIGS. 8 and 9, has a keypad console 500 for automatically operating the azimuth and elevation motors 456 and 463 to search for and lock onto a satellite. The parts of system 400 that correspond to the parts of system 30 have the same reference numbers with the prefix 4. Dish 457, arm 473, feedhorn 474, converter 476, and remaining dish rotating and elevating structures are all located under a dome, shown as dome 42 in FIGS. 2 and 3.

Key pad console 500 is a controller having a generally rectangular case 501 enclosing an electronic circuit including a microprocessor, ON and OFF switches 502 and 503, a key pad 504 having 1 to 9, 0, * and # switches, and a visual display 506. Display 506 has a flat panel for visually displaying readings and function of the satellite locator system. When 88 is displayed on the panel the satellite scan is complete and the system is locked onto a satellite.

Decimal digit numeric display 506 updates the operator with operational status of the roof top unit. The console 500 communicates serially with the roof top electronics over a six-conductor telephone circuit, using RS232 signal levels. The console 500 contains a PIC microprocessor to provide the intelligence to manage and control all of the console's communications functions. The two digit display 506 reports status sent to it from the roof mounted antenna system. The control console 500 gives the operator the capability to change satellite service types, modes, and geographic zone information, as well as monitor signal strength and dish elevation and azimuth. It also has a number of set up, diagnostic and configuration commands to facilitate installation and field service.

The satellite search is initiated after the receiver 497 and television 499 are turned ON by pressing ON switch 502. The program for keypad console is as follows: the 0 keypad is pressed for 2 seconds which initializes the system and begins the satellite search. Satellite search is in progress when display shows 55 flashing. When a potential satellite signal is found the display flashes 66. The system fine tunes the location of dish 457 relative to the satellite and locks onto the satellite and the display shows a steady 88. An image is present on the screen of television 499. The OFF switch 503 may be compressed if the correct satellite is located. The dish 457 remains locked onto the satellite. In the event that another satellite is to be located, the search is continued by pressing keypad 5.

The system can locate a satellite by scanning the entire sky, or it can selectively scan only certain elevations of the sky if it has a small amount of additional viewer supplied information. At the time of installation, a Satellite provider I.D. or number can be entered but is not required. The I.D. specifies which satellite provides the customer's service. This I.D. can be entered from the console and need only be entered once when the system is first installed or if the viewer should change satellite service companies. A viewer can choose to provide the system with an elevation zone code corresponding to the physical geographic location to reduce the time to locate the satellite. The system will begin its scan at or near the satellite's elevation, and will scan a much smaller region of the sky. The geographic location can be provided by entering a geographic zone number via the console keyboard or by actuating switch 95 a defined number of times. There may be as many as 16 zone numbers each associated with a line on a map of the United States or a corresponding chart of elevations. For best results, the viewer should enter the zone number of the line closest to his or her geographic location. The number can be entered via the control console by pressing * then the 2 digit zone number followed by the # sign, or by activating switch 95 a defined number to times. The zone number can be updated whenever the system is moved to a different geographic zone but is not required.

Depending upon where in the United States the system is located, all satellites will appear between 30 and 60 degrees elevation in the southern sky. The information provided by the zone number permits the system to limit its vertical scanning range. An electronic level located on the main controller module compensates for situations where the vehicle is not sitting level with operator entered elevational information. The satellite will normally be found within three scan cycles or about three minutes. The zone number also provides the system with azimuth information so that if two satellites are located at or near the same elevation, the system will select the correct one. In automatic mode, the system is able to differentiate between satellites located at or near the same elevation.

The dome covered platform design of the satellite locator system has distinct manufacturing and assembly advantages. It is an upgradeable modular system useable for a manual mode, a semi-automatic mode and an automatic in motion mode. Vehicle manufacturers can use an assembly process having identical device mounting and wiring procedures. The in-motion satellite locator system automatically alters the elevation and azimuth of dish 457 to maintain the dish on target with a selected satellite during movement of the mobile unit, such as a motor home. The signal to the receiver 497 is not interrupted during the voyage of the mobile unit thereby insuring continuous viewing of the television 499. Dome 42 covers the dish and modular components including motors 456 and 479 and control 477 mounted on turntable 47 and protects these structures and the electronic components from wind, weather conditions, and the forces of air associated with a moving vehicle so they do not affect the sensing of the satellite signal. The microchip 482 in the controller 477 is reprogrammable or replaceable with another microchip as it has a socket connection on the circuit board. The replaced microchip may be programmed to accommodate signals from an in-motion module 600, shown in FIG. 8, which control azimuth motor 456 to maintain a southern locked on orientation of dish 457 regardless of the direction of movement of the mobile unit. Motion module 600 includes electronics, such as an electronic compass and/or a gyro instrument. Control 477 has a 910 connector which can be connected to a remote computer, such as a lap top computer, to reprogram the microchip or the 910 connector can be used as the in motion module to control 477 interface.

As seen in FIG. 8, the satellite locator system can be upgraded with a telephone line or cable 601 that connects the in motion module 600 to control 477. The in-motion module 600 is located in a position under dome 42 or within the mobile unit to minimize compass gyro and other electronic error due to instruments and equipment adjacent dome 42 and within the mobile unit and to facilitate simple upgradability. The electronic error can be adjusted for known equipment and structures. The in-motion module 600 generates a direction signal indicating magnetic north for the location of the mobile unit and senses motion via gyros. The directional signal is used by control 477 to change the azimuth of the dish to face the dish toward the southern sky and directly focused on a selected satellite. A gyroscope instrument can be used to provide the directional signal required ensuring that the dish points directly at and stays locked on a selected satellite regardless of the motions of a mobile vehicle.

While there have been shown in the drawings and described what are present to be preferred embodiments of the present invention, it is understood by one skilled in the art that changes in the structures, arrangement of structures, materials, electronic controls and programs and methods can be made without departing from the invention. Other variations, applications and ramifications of the invention within the skill of a person in the art are included in the present specification and the following claims.

What is claimed is:

1. A dome covered satellite dish apparatus operably connectable to a satellite receiver within a mobile unit, the apparatus comprising:

a dielectric dome;

a satellite dish defining a focal point disposed under the dome; and an automated positioning system that selectively controls position of the satellite dish while the mobile unit is stationary; the automated positioning system including:

a feedhorn and a signal converter operably located at the focal point of the satellite dish;

an azimuth control system and an elevation control system operably coupled to the satellite dish to selectively change an elevational position and an azimuth position of the satellite dish in accordance with a rotational search pattern; and an electronic leveler apparatus operably coupled to the elevation control system to automatically adjust the elevational position of the satellite dish to maintain a constant level of a horizontal plane as the satellite dish is rotated through the rotational search pattern.

2. A dome covered satellite dish apparatus operably connectable to a satellite receiver, the apparatus comprising:

a dielectric dome;

a satellite dish defining a focal point disposed under the dome; and an automated positioning system that selectively controls position of the satellite dish; the automated positioning system including:

a feedhorn and a signal converter operably located at the focal point of the satellite dish;

the signal converter to supply an output signal for the satellite receiver;

an azimuth control system and an elevation control system operably coupled to the satellite dish to selectively change an elevational position and an azimuth position of the satellite dish in accordance with a rotational search pattern; and an electronic control module that stores a current position of the satellite dish as a stored signal position if said current position corresponds to a valid satellite signal, said electronic control module bypassing analysis of a subsequent position if said subsequent position matches said stored signal position.

3. A dome covered satellite dish apparatus operably connectable to a satellite receiver, the apparatus comprising:

a dielectric dome;

a satellite dish defining a focal point disposed under the dome; and an automated positioning system that selectively controls position of the satellite dish; the automated positioning system including:

a feedhorn and a signal converter operably located at the focal point of the satellite dish, said signal converter having a distal end disposed no more than 2 centimeters from an inside surface of the dome; and an azimuth control system and an elevation control system operably coupled to the satellite dish to selectively change an elevational position and an azimuth position of the satellite dish in accordance with a rotational search pattern.

4. A dome covered satellite dish apparatus operably connectable to a satellite receiver, the apparatus comprising:

a dielectric dome;

a metallized satellite dish defining a focal point disposed under the dome, said metallized dish including an etched pattern that can collect UHF/VHF signals; and an automated positioning system that selectively controls position of the satellite dish while the mobile unit is stationary; the automated positioning system including:

a feedhorn and a signal converter operably located at the focal point of the satellite dish;

an azimuth control system and an elevation control system operably coupled to the satellite dish to selectively change an elevational position and an azimuth position of the satellite dish in accordance with a rotational search pattern.

5. A satellite dish apparatus operably connectable to a satellite receiver, the apparatus comprising:

a satellite dish defining a focal point; and an automated positioning system that selectively controls positioning of the satellite dish, the automated positioning including:

a feedhorn and a signal converter operably located at the focal point of the satellite dish, the signal converter supplying an output signal to the satellite receiver;

an azimuth control system and an elevation control system operably coupled to the satellite dish to selectively change an elevational position and an azimuth position of the satellite dish in accordance with a rotational search pattern;

an electronic control module that includes a stored memory of previously located satellites; and a controller to direct the electronic control module of the automated positioning system to point the satellite dish from a current position corresponding to a valid satellite signal to a selected second position corresponding to the previously located satellites.

6. A satellite dish apparatus operably connectable to a satellite receiver within a mobile unit, the apparatus comprising:

a satellite dish defining a focal point;

a feedhorn and a signal converter operably located at the focal point of the satellite dish;

an automated positioning system that selectively controls positioning of the satellite dish while the mobile unit is stationary, the automated positioning system including an azimuth control system and an elevation control system operably coupled to the satellite dish to selectively change an elevational position and an azimuth position of the satellite dish in accordance with a search pattern; and a remote hand held control console operably connected to the automated positioning system.

* * * * *

UNITED STATES PATENT AND TRADEMARK OFFICE
Certificate

Patent No. 6,864,846 B2 Patented: March 8, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Lael D. King, St. Louis Park, MN (US); and James P. Boardson, Roseville, MN (US).

Signed and Sealed this Twelfth Day of June 2007.

DOUGLAS W. OWENS
*Supervisory Patent Examiner*
Art Unit 2821